United States Patent [19]

Bentley et al.

[11] 4,414,917

[45] Nov. 15, 1983

[54] SYSTEM FOR SELECTIVELY TREATING CABLES AND THE LIKE

[75] Inventors: Joseph J. Bentley, Goleta; Thomas E. Brown, Los Angeles; Jerome Unrine, Ventura, all of Calif.

[73] Assignee: Industrial Cleaning and Coating, Inc., Ventura, Calif.

[21] Appl. No.: 455,409

[22] Filed: Jan. 3, 1983

[51] Int. Cl.[3] ..... B05C 5/00

[52] U.S. Cl. ..... 118/695; 118/704; 118/63; 118/67; 118/72; 118/73; 118/314; 118/316; 118/325; 134/64 R

[58] Field of Search ..... 118/DIG. 11, 314, 315, 118/316, 73, 72, 68, 67, 63, 695, 704, 325; 134/64 R, 102; 15/306 A, 316 R

[56] References Cited

U.S. PATENT DOCUMENTS

| | | | |
|---|---|---|---|
| 1,575,526 | 3/1926 | Böcher | 118/73 X |
| 1,941,002 | 12/1933 | Harrison | 118/316 X |
| 2,114,377 | 4/1938 | Goss | 118/302 X |
| 2,781,280 | 2/1957 | Miller | 118/316 X |
| 2,893,895 | 7/1959 | Claussen | 118/309 X |
| 3,044,098 | 7/1962 | Stalson | 134/64 R X |
| 3,306,310 | 2/1967 | Grant | 118/316 X |
| 3,361,111 | 1/1968 | Strobel et al. | 118/309 |
| 3,438,803 | 4/1969 | Dubble et al. | 118/314 X |
| 3,533,761 | 10/1970 | Pierson | 118/63 X |
| 4,096,300 | 6/1978 | William et al. | 118/72 X |
| 4,148,274 | 4/1979 | Stievenart et al. | 118/683 X |

*Primary Examiner*—John P. McIntosh
*Attorney, Agent, or Firm*—Perry E. Turner

[57] ABSTRACT

There is disclosed a system incorporating aligned cylinders through which a cable is moved. The cylinders have jet nozzles connected to respective manifolds which are adapted for receiving different fluids for treating the cable. Control apparatus is provided for operating the cylinder stages simultaneously, and permitting manual selection of any one or combination of such operations. With fluid applied to all nozzles simultaneously, the cable is successively blast cleaned with water, jet dried with air, and jet lubricated with oil. Also shown is control apparatus adapted to control a motor for moving the cable through the cylinders. The air drying station includes nozzles for moving the air tangentially and from the exit to the entrance end of the air cylinder, for drying the cable and preventing water from the cleaning station from entering the drying station. The cylinders are split, with their halves mounted for pivotal movement on a base that houses the manifolds, and hose connections are made from the nozzles of each half to the associated manifold. Dump tubes are provided for the cleaning and lubricating cylinders, and control apparatus is shown for recycling oil from the lubricating cylinder.

14 Claims, 10 Drawing Figures

SYSTEM FOR SELECTIVELY TREATING CABLES AND THE LIKE

BACKGROUND OF THE INVENTION

1. Field of the Invention

This invention relates to methods and apparatus for cleaning or otherwise treating cables, pipes and the like.

2. Description of the Prior Art

There has long been a need for efficient, effective maintenance of cables exposed to corrosive environments. For example, cables used in sea water are damaged by salt, mud and algae. So deleterious are the resulting chemical attacks and abrasions from salt and dirt particles that the wear and weakening of cables necessitates their replacement after an undesirably short life. Typically, cables used for anchors in an ocean environment have to be replaced after a year and a half of use, and sometimes less than a year in cases of frequent use.

Such cables represent a tremendous investment, which is a substantial reason and desire to try and prolong their useful life. However, this is not possible with methods and apparatus heretofore known and used. For example, it is known to haul cable up and lubricate it by running it through a sleeve to which oil is supplied via a fitting to a channel through which the cable moves. The sleeve at its ends has means to wipe the cable, and this can operate to shorten cable life instead of prolonging it. In this regard, salt and mud that become lodged between cable strands cannot be removed by merely wiping and oiling it, or even hosing it off before wiping and oiling. During oiling, these particles remain, and function as abrasives even as the cable is wiped on entering and leaving the oiler. Afterwards, when the cable is returned to normal ocean use, these same materials remain to continue attacking the metal, and contributing significantly to a shortened useful life.

BRIEF SUMMARY OF THE INVENTION

This invention embraces a system of treatment stations including cylinders through which to move a cable, each cylinder carrying nozzles, means to supply a respective fluid under pressure to the nozzles of each cylinder, and means to selectively couple the fluid supply means to said nozzles. Also embraced is control means whereby to manually select any one or combination of cylinders to receive fluids from associated supply means, and means for automatically coupling all cylinders to associated supply means. This invention also embraces a control means in which motor means is operable to move a cable through the cylinders. Structure embraced by this invention includes split cylinders pivoted on a support base which houses manifolds to receive the fluids, hose means interconnecting nozzles of each cylinder half and the associated manifold, and dump means for each cylinder to which liquid fluids are supplied. This invention includes air drying means in which nozzles of the cylinder to which air is supplied being oriented to direct air tangentially of the cable and from one end of the cylinder to the other.

DESCRIPTION OF ILLUSTRATIVE EMBODIMENTS

Figure 1:
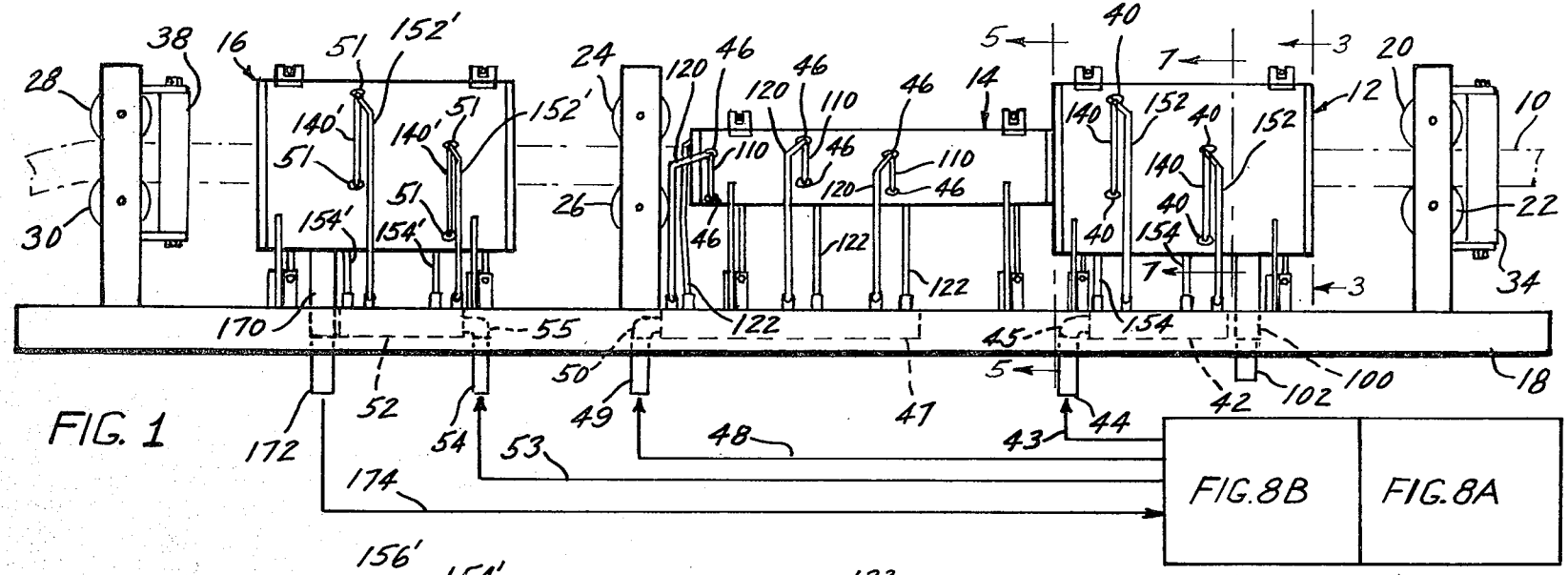
FIG. 1 is a side elevation view of cylinders arranged in accordance with this invention above a base that houses manifolds under the cylinders, and showing tube connections and nozzles schematically for interconnecting nozzles and manifolds to receive fluids for treating cable moved through the cylinders.
Figure 2:
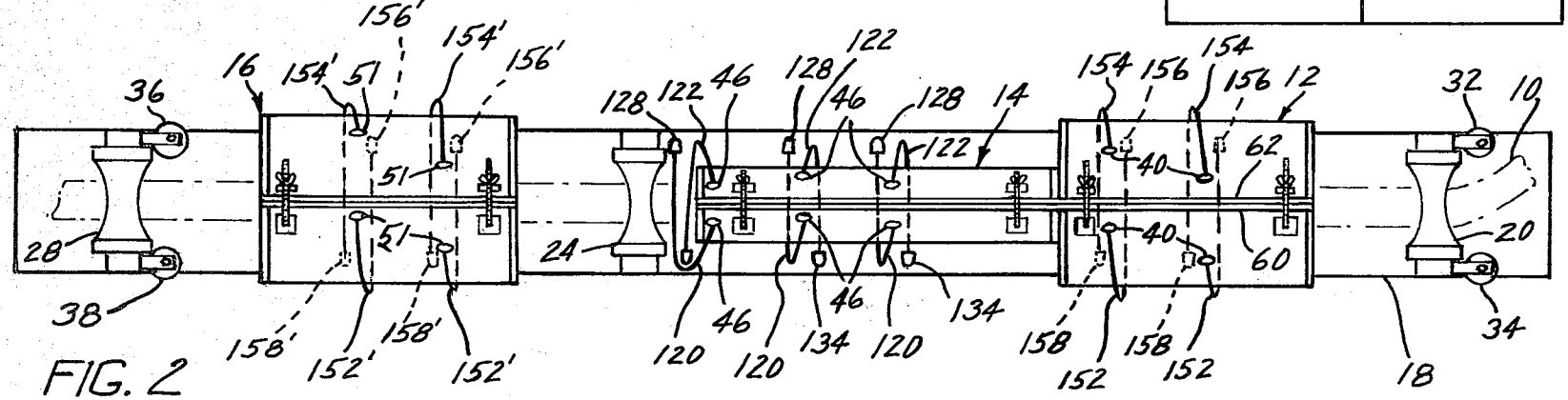
FIG. 2 is a top plan view of the structure shown in FIG. 1, but showing schematically the connections to the manifolds of the nozzles in each half of each cylinder.

Referring to FIGS. 1 and 2, a cable shown in phantom at 10 is moved through cylinders 12, 14, and 16 that are mounted on a base 18 with their axes aligned. The cable is suitably supported so that it moves on the axis of the cylinders, as by having it pass between horizontal rollers 20, 22 before entering the cylinder 12, between horizontal rollers 24, 26 at the exit end of the cylinder 14, and between similar rollers 28, 30 adjacent the exit end of the cylinder 16. Also, pairs of vertical rollers 32–38 bracket the horizontal rollers 20, 22 and 28, 30. The various rollers are configured and dimensioned so as to prevent the cable at either end from getting bound or wedged between the ends of the horizontal rollers.

In sequence, the cable in automatic operations is subjected to successive water jet or blast cleanings as it moves through the cylinder 12; is air jet dried as it moves through the cylinder 14; and is successively jet sprayed with oil as it moves through the cylinder 16. To this end, the cylinder 12 is provided with nozzles 40 which are connected to a manifold 42 located within the base 18. Water under high pressure is applied to the nozzles 40, such water being passed through a line 43 and hose connection 44 to the inlet fitting 45 of the manifold.

The cylinder 14 is provided with spaced sets of nozzles 46 which are all connected to a manifold 47 housed in the base 18. Air under pressure is supplied through a line 48 and connection 49 to the inlet fitting 50 of the manifold 47. As will be explained, the air is utilized in a novel manner to dry the cable and to prevent water from the cylinder 12 from entering the cylinder 14.

For the lubricating function, the cylinder 16 is provided with sets of nozzles 51 which are connected to a manifold 52 located beneath the cylinder 16 within the base 18. Oil under pressure is supplied through a line 53 and connection 54 to the inlet fitting 55 of the manifold 50.

Figure 4:
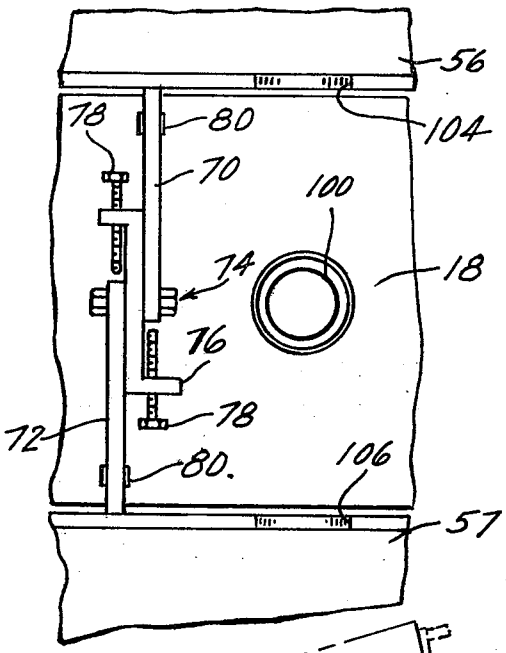
FIG. 4 is a fragmentary top plan view of the cylinder of FIG. 3, with the cylinder halves pivoted to open position.
Figure 3:
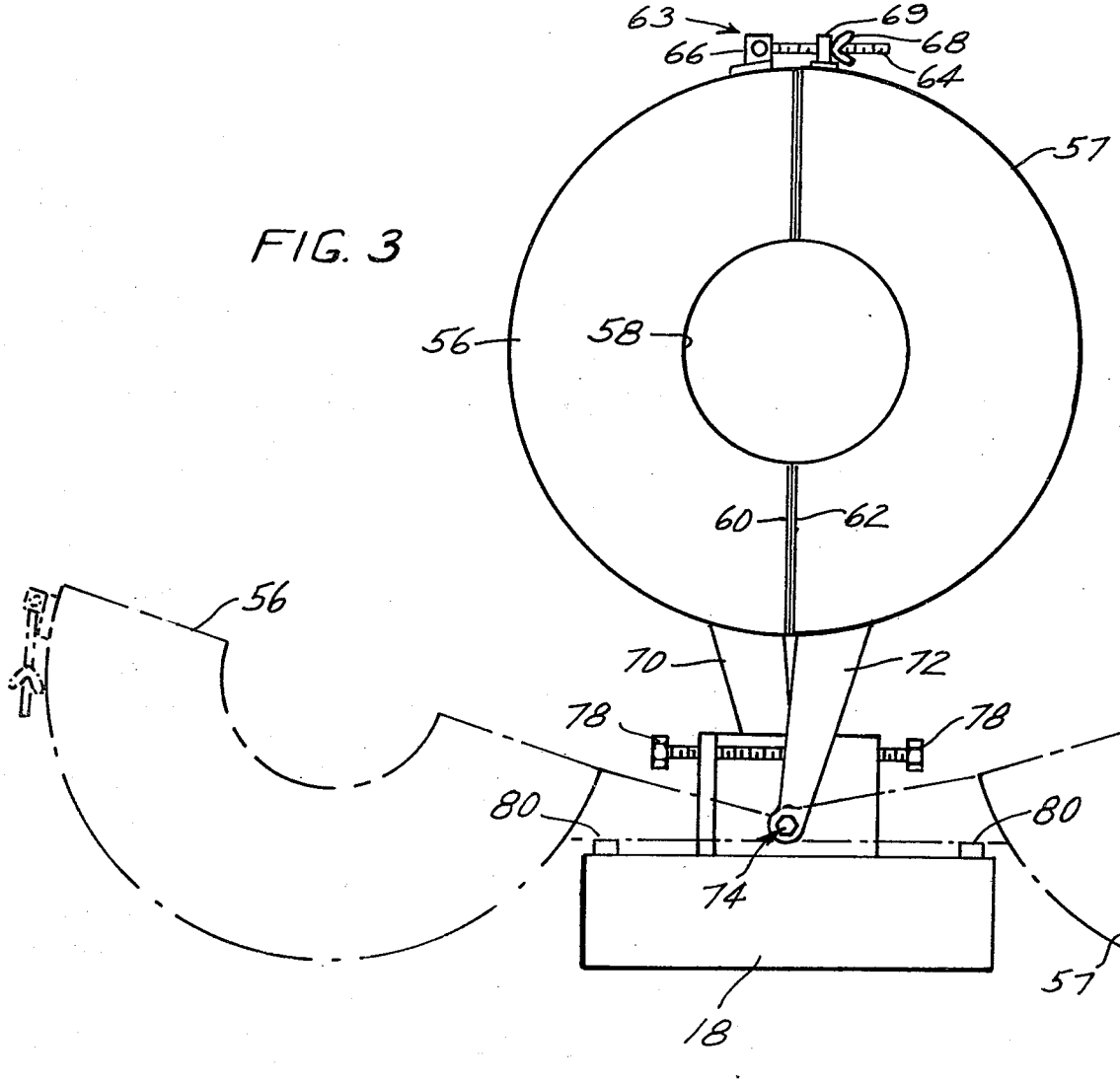
FIG. 3 is an end view taken along the line 3—3 of FIG. 1, showing the halves of the cylinder supported for pivotal movement on the base.

The cylinders 12, 14, 16 are split cylinders which are pivotally mounted on the base 18 so they can be opened as needed for maintenance purposes, such as cleaning and replacement of nozzles. FIGS. 3 and 4 represent the mechanial features for supporting, positioning and releasably fastening the halves of the cylinders together. The features are essentially the same for all three cylinders, being identical for the cylinders 12, 16 which are of the same size, and differing for the cylinder 14 in dimensions due to the smaller diameter of the cylinder 14.

In FIG. 3, the cylinder 12 is composed of semi-cylindrical sections 56, 57 with end plates which meet and define a central opening 58 for receiving the cable. The confronting edges of the two sections 56, 57 preferably are coated with a sealing material, indicated at 60, 62 so as to form a fluid tight seal along the lengths of the sections and between the abutting edges of the end plates. Where the cylinder is made of metal, the sealing may be effected by coating all inner and outer surfaces and edges of the cylinder halves with the sealing material. The coating provides protection for the metal surfaces by preventing foreign particles washed from the cable from contacting the metal. It will be understood that the cylinders may be made of plastic, if desired. Choices for the materials forming the cylinders, and the material for the sealing, will be dictated by the fluid media to be encountered.

For releasably clamping the cylinder halves 56, 57 together, any suitable means may be employed. In this example, conventional wing nut clamping means is employed as indicated at 63, wherein a threaded bolt 64 is pivoted in a block 66 on one cylinder half, and a wing nut 68 on the bolt is turned against a block 69 on the other cylinder half and through which the bolt extends.

Below the fastening means near each end of the cylinder are respective flat plates 70, 72 which are welded or otherwise made integral with the cylinder halves 56, 57, and which are pivotally mounted at 74 adjacent the top of the base 18 and on opposite sides of a vertical support plate 76 that is welded to the top of the base. The support plate 76 is flanged at its ends and threaded to receive bolts 78 which are adjustable to have their inner ends engaged by the inner edges of the plates 70, 72 when the cylinder halves are closed and clamped together. Thus, the bolts 78 serve as limit stops and aid in holding the cylinder in stable position when its halves are closed, and coact with the fasteners 63 to insure that the halves are in firm sealing engagement when clamped together.

When the cylinder halves are to be opened, the clamps are released and the halves are lowered to the positions shown in phantom in FIG. 3, and in solid lines in FIG. 4. In such positions, the plates 70, 72 come to rest atop bumpers 80 which extend above the top of the base 18. As will be seen hereinafter, the bumpers aid in preventing hose connections from being crimped against the base when the cylinder is opened.

As previously indicated, as the cable 10 moves through the cylinder 12, it is subjected to water jet cleaning at spaced points in its travel. In this regard, and referring to FIG. 7 along with FIG. 1, the nozzles 40 preferably are of the type which are adapted to eject water in a plane-like fan covering a relatively small acute angle, such as 20°. With the multi-strand cable as shown, it has been found that such water jets at a high pressure is effective to dislodge and wash out salt and debris from crevices between strands, wherein such jets are directed at the cable from nozzles angularly spaced 90°, and with the four nozzles at the two locations indicated being displaced 45° relative to each other.

Figure 7:
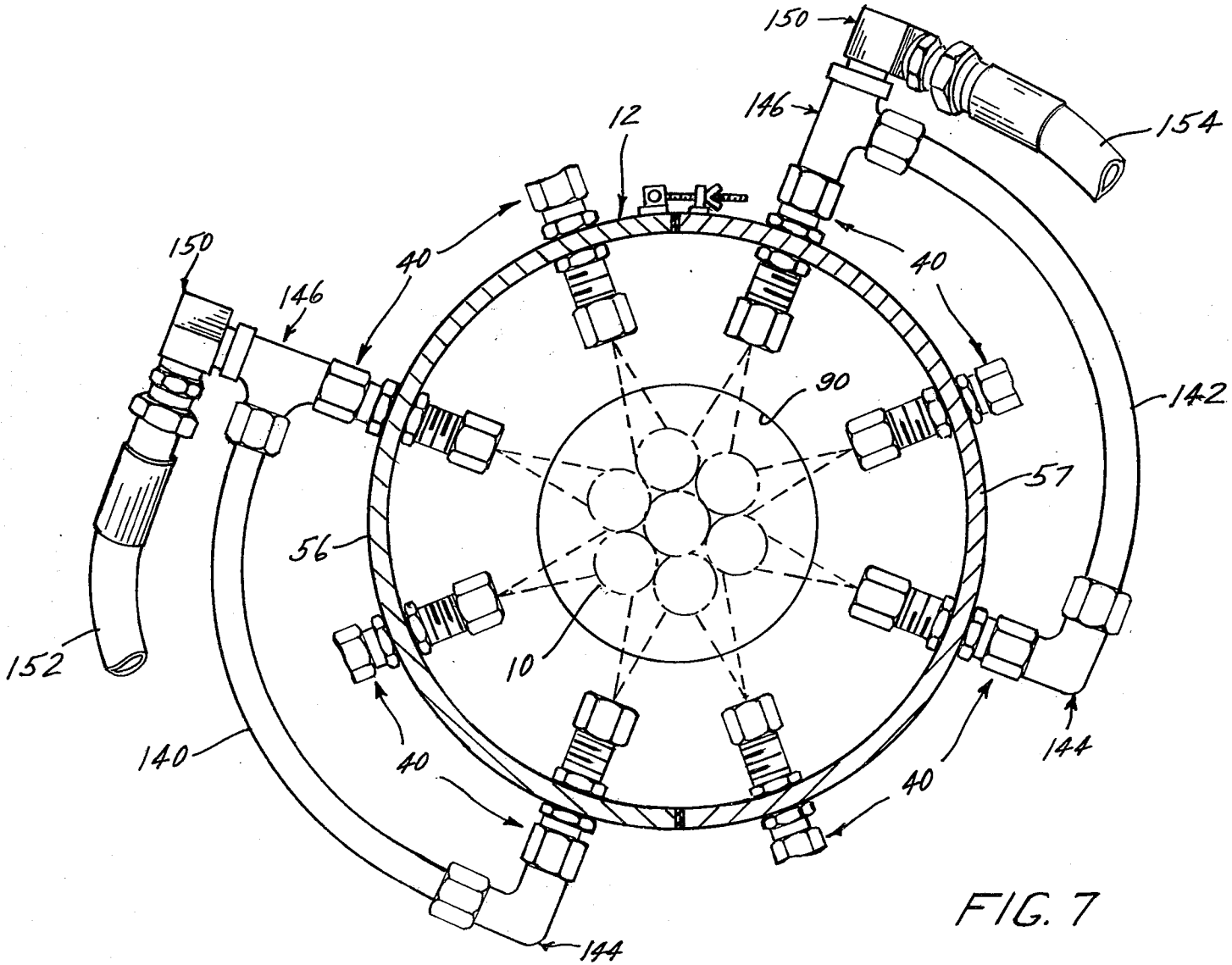
FIG. 7 is a fragmentary sectional view taken along the line 7—7 of FIG. 1, showing the nozzle arrangement for the water cylinder.

FIG. 7 shows an opening 90 surrounding the cable 10 at the exit end of the cylinder 12. Such opening is also the same as the internal diameter of the air drying cylinder 14, e.g., a 4-in. opening for a system designed to treat cables as large as 3-inch diameter cables. In this regard, the opening at the entrance end of the cylinder 12, as are the openings at the exit end of the air cylinder 14 and both ends of the lubricating cylinder, are preferably only slightly larger in diameter than the largest diameter cable the system is adapted to accommodate. For example, such smaller openings may be 3.5 inches in diameter for a system adapted to treat 3-in. diameter cables. For the entrance end of the water cleaning cylinder and both ends of the lubricating cylinder, such smaller openings are effective to prevent the liquids from passing out of such openings in objectionable quantities. Such smaller opening at the exit end of the air drying cylinder is of use in simplifying nozzle adjustment for the desired zero pressure differential at that end.

Further in this regard, the arrangement of cylinders in FIG. 1 is one in which the confronting ends of the cylinders 12, 14 are in close proximity. They are in near touching engagement but able to be opened and closed without frictional contact. The sets of nozzles 46 spaced along the cylinder 14 will be seen to have one set immediately adjacent the exit end. These sets of nozzles are arranged to effect drying of the cable in a unique manner, as will now be explained with reference to FIGS. 5 and 6 along with FIG. 1.

Figures 5, 6:
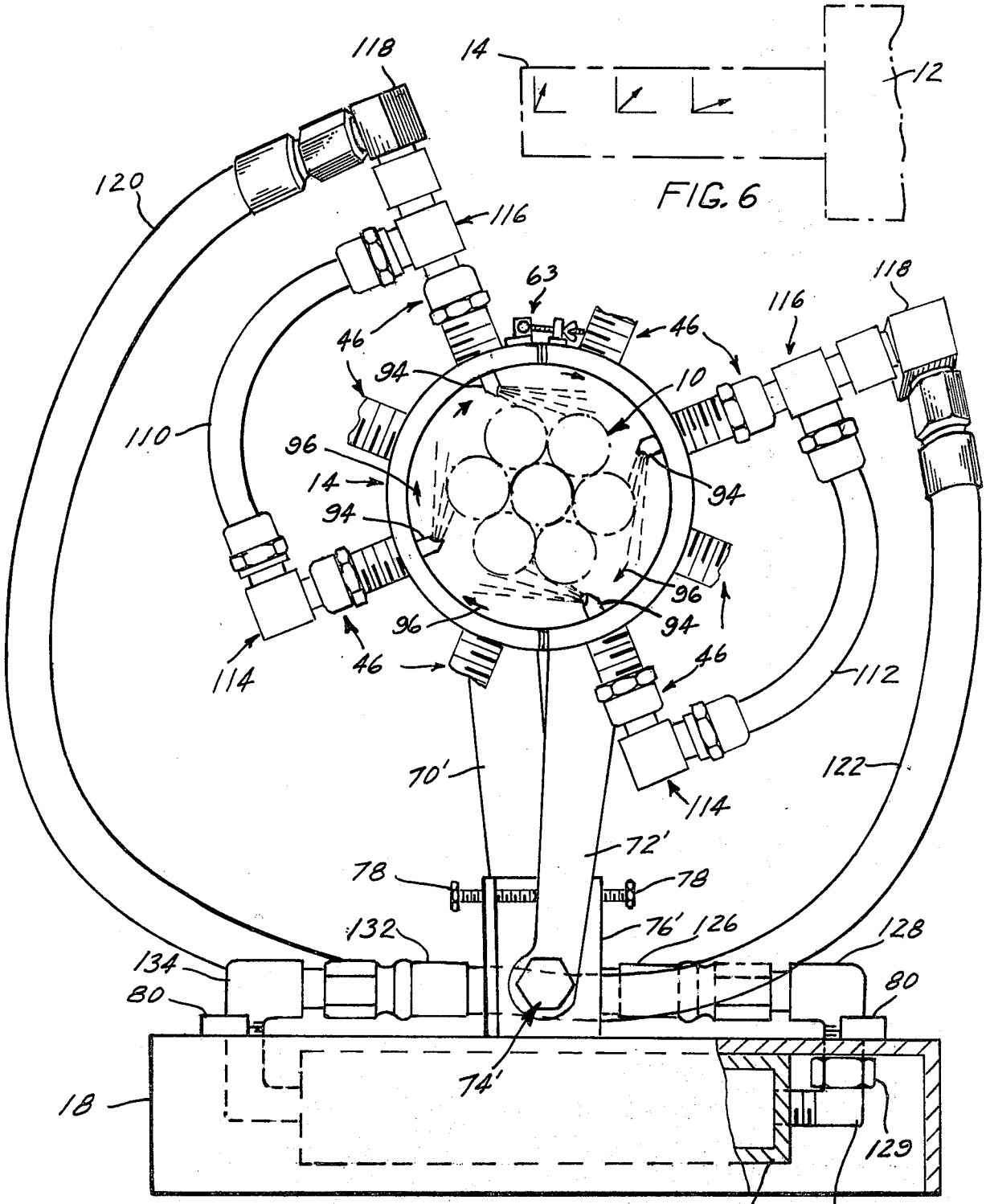
FIG. 5 is an end view, with the base partly broken away and in section, taken along the line 5—5 of FIG. 1, showing the physical connections of nozzles of the respective halves of the air cylinder, and hose connections of such interconnected nozzles to the manifold beneath the base.
FIG. 6 is a top plan view in phantom of the air cylinder and portion of the adjacent water cylinder, and showing graphic representations of the nozzle orientations for moving air from the exit to the entrance ends of the air cylinder.

The nozzles 46 will be seen in FIG. 5 to have their tips configured to direct air tangentially of the cable 10. The air is thus directed as indicated by the dotted lines, with a resulting flow around the interior of the cylinder as indicated by the arrows 96. However, and in addition, the nozzles 46 have their tips angularly oriented so that air emerging from them is directed towards the entrance end of the cylinder 14. Thus, and referring to FIG. 6, in one example the nozzles adjacent the exit end of the cylinder have their tips oriented so that, relative to a diametral plane through the tips, air is directed at a 22° angle. This sets up a swirling of the air towards the entrance end, which is aided by the sets of nozzles upstream, wherein in this example the middle set have their tips oriented to direct air at a larger angle of 45° relative to a diametral plane through them, and the set nearest the entrance have their tips arranged to direct air from them at 67°.

Such tangential and backward movement of air from the jet nozzles is effective to remove water from the wet cable and direct it back into the cylinder 12; it dries the cable strands; and it presents a volume of air flow at the entrance end of the drying cylinder 14 which prevents water injected into the cylinder 12 from entering the drying cylinder.

Furthermore, the drying method of this invention has the characteristic that although the cylinder 14 has its exit end open to the atmosphere, the movement of air within the cylinder is accomplished without involving air outside the cylinder. With the tips of the nozzles 46 set at angles as described, it has been found that there is a zero pressure differential at the exit opening of the cylinder 14. The zero pressure differential is established by making minor adjustments in the angular orientations of the nozzles adjacent the exit end after setting the different sets of nozzles at the angles indicated. Such adjusting is done upon setup, and following cleaning operations and nozzle replacements should readjusting be needed.

With the air in the cylinder 14 functioning as described, water conveyed therefrom back into the cylinder 12, along with the high pressure water falling away from the cable after striking it, is passed out of the cylinder 12 through a dump tube or pipe 100 (see FIGS. 1 and 4) that extends from the bottom of the cylinder through the top of the base 18, and through a hose connection 102 to the dump tube.

The upper end of the dump tube 100 is sealingly engaged by the lower portions of the cylinder halves 53, 54 which, as is best seen in FIG. 4, have semicircular grooves 104, 106 which, upon closing the cylinder halves together, encircle the upper end of the dump tube. Desirably the coating of sealing material previously described also covers the grooves 104, 106.

FIG. 5 illustrates a generally preferred arrangement for connecting the nozzles carried by the various cylinder halves to their associated manifolds. For each set, the pairs of nozzles 46 in the halves of cylinder 14 are directly connected via tubes 110, 112 via suitable elbow and tee fittings 114, 116. The remaining legs of the tee fittings 116 are connected at 118 to respective hoses 120, 122. The hoses 120, 122 extend down below the cylinder and across the base 18 to pass through or below the pivot axis of the cylinder halves. The pivot axis is the same for the halves of all cylinders. To this end, the halves of the cylinder 14, which is of smaller diameter than the other cylinders, are provided with longer plates 70', 72' corresponding to the plates 70, 72 shown in FIG. 3 for the cylinder 12, which are pivotally mounted at 74' to the associated flanged support plates 76'.

The lower end of the hose 120 that extends across the base 18 past the pivot axis is connected at 126 to a fitting 128 that extends through the top of the base and is connected at 129 to a fitting 130 that leads from the interior of the manifold 47. In similar fashion, the lower end of the right hand hose 122 in FIG. 5 is connected at 132 to a fitting 134 that is similarly coupled to the side of the manifold 47. With this arrangement, as the cylinder halves are unclamped and lowered, the plates 70', 72' come to rest atop the bumpers 80 and the hoses undergo minimal flexure and stress, and do not contact the base 18, thereby being assured a long useful life. If desired, of course, connections of the lower ends of the hoses may be made to fittings on the same side of the base as the upper end of the same hoses without departing from the spirit and scope of this invention. However, it will be observed that if the hoses 120, 122 were shortened and connected to the fittings 134, 128 respectively, they would undergo flexure during movements of the cylinder halves between open and closed positions, and this would necessitate more frequent replacement of the hoses.

By attaching the lower ends of the hoses to fittings in the base in the preferred manner described, the fittings 128, 134 are appropriately spaced along the base so the hoses will not be in interfering relation. Correspondingly, the hoses 120, 122 are appropriatedly oriented, and to this end the fittings 118 to which the upper ends of the hoses are connected are angled so the hoses pass below the cylinder and cross to the opposite sides of the base without interference. Such angling may permit the hoses to pass on opposite sides of the plane in which the nozzle tips are located, as in the case of the two sets nearest the cylinder 12, or to the same side of such plane as in the case of the set nearest the exit end of the cylinder 14. In either case, the fittings 128, 134 are appropriately staggered to accommodate such noninterfering positioning of the hoses.

FIG. 2 illustrates the hose connections to the base fittings diagramatically as single lines, to facilitate visual perception of the hose orientations as above described. Thus, the lines 120, 122 along the cylinder 14 can be seen leading around the respective cylinder halves and crossing the base to the fittings 128, 134 at the sides. Similar hose connections are provided for the sets of nozzles of the water cleaning cylinder 12, and for those of the lubricating cylinder 16.

Referring to FIG. 7 along with FIGS. 1 and 2, for the pairs of nozzles 40 of each set, the nozzles secured to the respective cylinder halves 53, 54 are connected to the ends of respective tubes 140, 142 via appropriate elbow and tee fittings 144, 146. In the manner of the hose connections previously described for the air drying cylinder, the nozzles 40 are connected via the fittings 150 to respective hoses 152, 154, through which water under pressure is to be applied to the nozzles. The fittings 150 are appropriately angled, so that, as illustrated in FIGS. 1 and 2, the lower ends of the hoses 152, 154 pass around and below the cylinder halves and across the top of the base 18 where their lower ends are connected to respective fittings 156, 158 to the associated manifold 42. The hoses 152, 154 also pass through or below the pivot axis of the cylinder halves.

In the lubricating cylinder 16, nozzle placements and connections, and hose orientations, are substantially identical to those of the water cleaning cylinder 12. For ease of identification, the nozzle connecting tubes, the hose connections and the fittings to the manifold 53, are shown with prime numbers corresponding to the associated parts of the cylinder 12.

The nozzles 49 carried by the halves of the cylinder 16 are essentially identical in spacing and operation as those of the cylinder 12, but with the exception that the nozzle tips are adapted to provide sprays or jets over a substantially larger angle. In one example, whereas the tips of the nozzles 40 in the cylinder 12 eject water over a 20° angle, those of the nozzles 49 of the cylinder 16 eject oil over a 60° angle. Thus, the cable, which is clean and dry emerging from the cylinder 14, and entering the cylinder 16, is jet sprayed with oil at two locations within the cylinder. Since the nozzles of the two sets are angularly displaced 45° with respect to each other, the cable is assured of being thoroughly wetted with oil by the time it emerges from the cylinder 16.

Figure 8A:
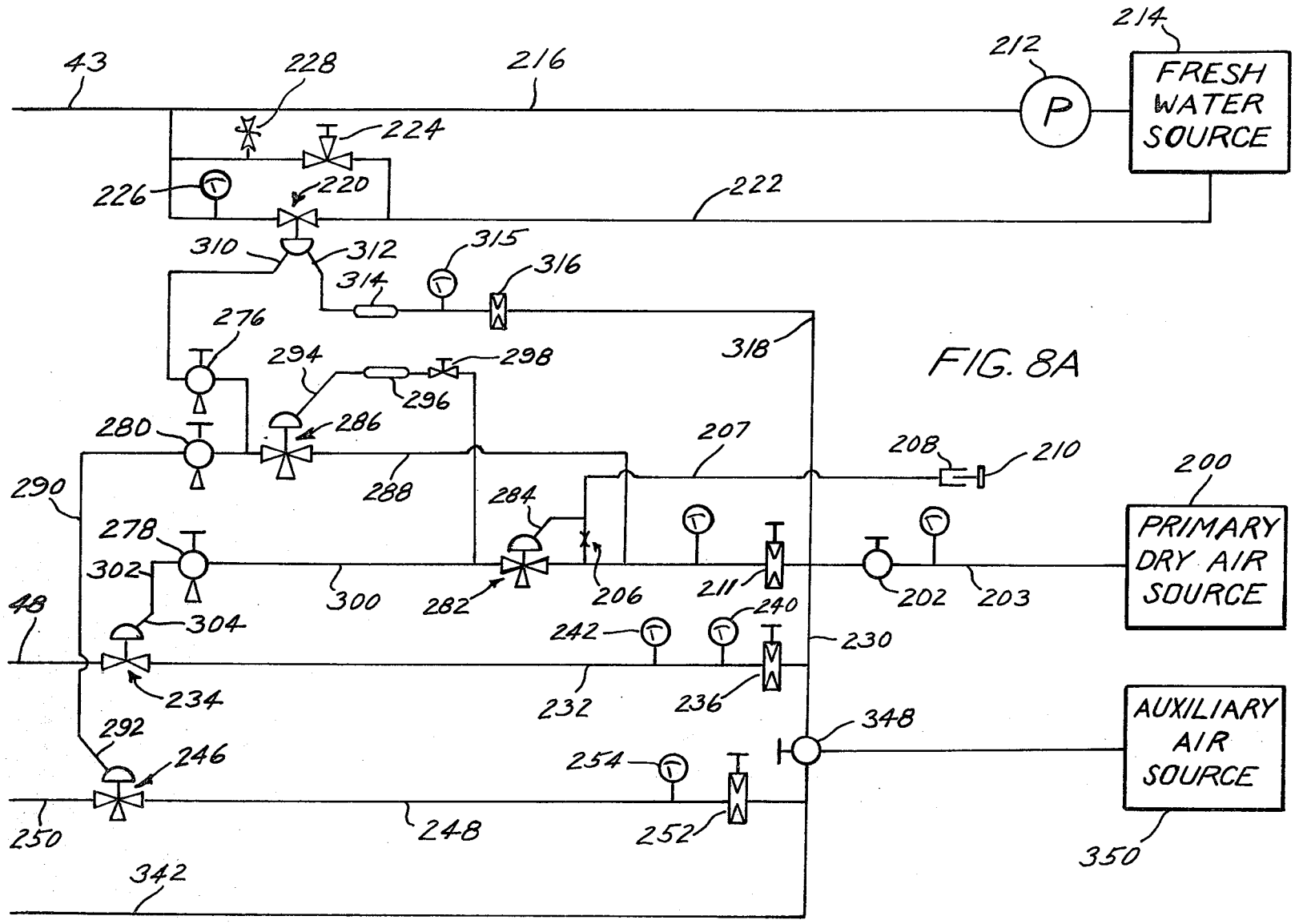
FIGS. 8A and 8B are combined schematic and flow diagrams of a control system of the invention for selectively operating the various portions of the cable treatment stations automatically and/or under manual control.
Figure 8B:
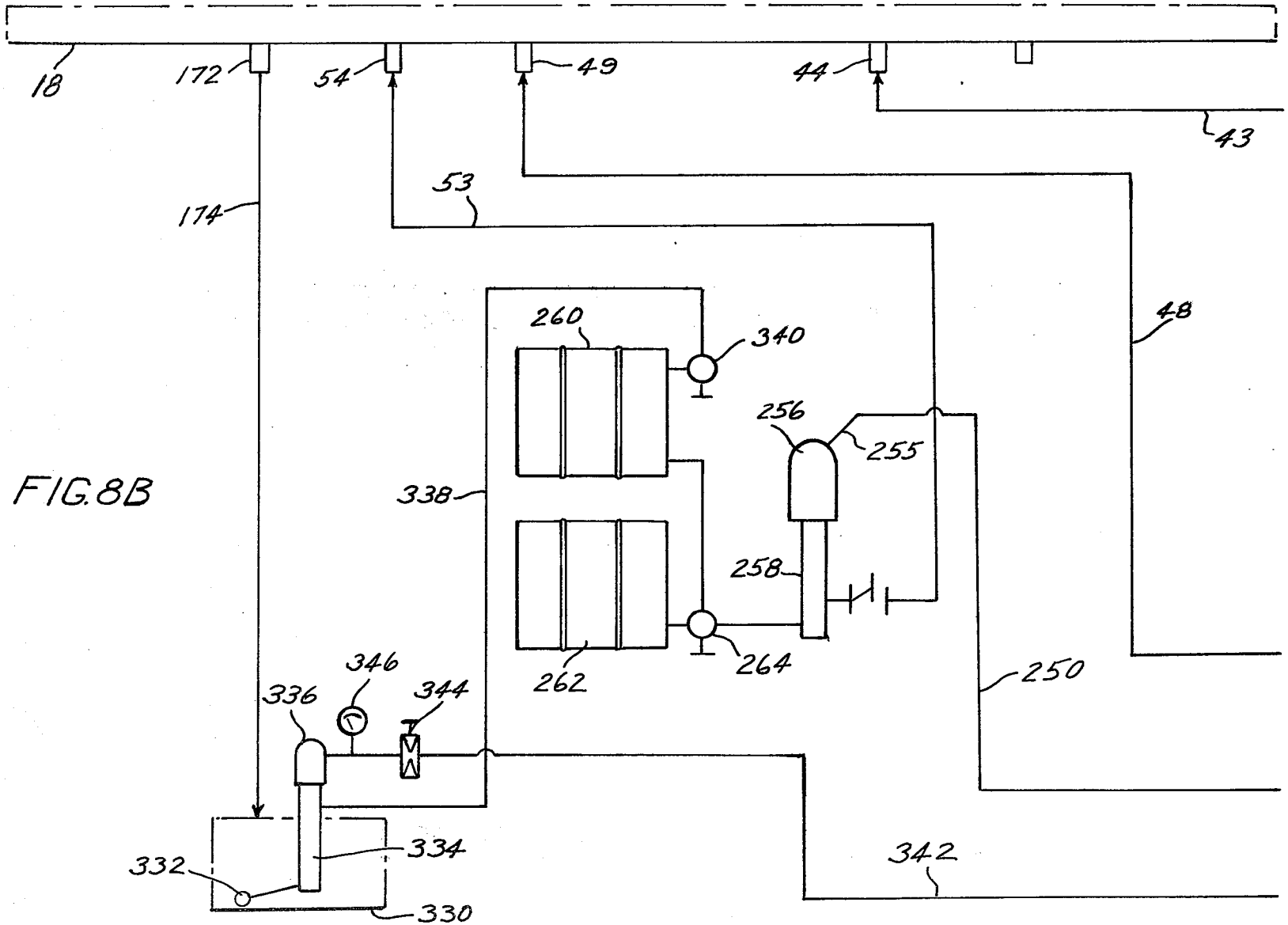

Still referring to FIG. 1, excess oil passes out of the cylinder 16 through a dump tube or pipe 170 and a hose connection 172 therefrom to pass through a line 174 to be reused if desired, e.g., as by passing into a drip pan and back to the cylinder through the line 51 via the control system of FIGS. 8A and 8B.

Referring to FIGS. 8A and 8B, a control system in accordance with this invention is shown in which no electrical unit is used, thus making the control system safe for use with the cylinder constructions around dangerous materials such as flammable oils and the like. The control system utilizes air pressure to effect application of all fluids—water, air and oil—to the various cylinders. To this end, there is provided a primary dry air source 200, composed by way of example of an air compressor and multiple stage dryers. Air flow from the source 200 is at a desired volume and pressure, e.g., 185 cfm at 125 psi. A main shutoff valve 202, such as a ball valve, is connected in the line 203 from the source 200. With the valve 202 open, air flow is normally bled or vented to the atmosphere, and pressure within the system is too low to effect operations of any of the cable treatment sections.

In this regard, a valve unit 206 is connected between the line 203 and a line 207 to a normally open pneumatic switch 208, and functions to direct air through the switch while its control button 210 is undepressed. The switch unit 206 is a conventional one in which a needle valve and check valve are combined. It provides a flow control orifice, and is set to limit flow for various control valves in the system until the button 210 is pressed. A pressure regulator 211 is provided in the line 203 for use in setting the valve unit 206.

The sections or portions of the system pertaining to the respective fluids will now be described. For the water blast cleaning operation, a pump 212 is connected to a fresh water source 214, and is adapted to supply water at a desired volume and high pressure via lines 216, 43 to inlet 44 of the manifold for the nozzles in the water treatment cylinder 12. The pump 212 may be a positive displacement pump, from which the constant volume of water is suitably restricted so that the water applied to the associated nozzles is at the desired pressure.

Before the control button 212 is pressed, water from the pump 212 is simply recirculated through a normally open valve 220 connected in a line 222 between the water source 214 and the junction of the lines 216, 43. A needle valve 224 is shown shunting the valve 220, and is adjusted to establish the desired pressure, such setting being made with reference to a gauge 226 in the line 222. Desirably, a safety relief valve 228 provides a bleedoff point should the water pressure exceed the desired setting for any reason. In a manner to be explained, the valve 220 is closed when the control button 210 is pressed, and such closure causes cutoff of the recirculating path and the water is applied through the lines 216, 43 to the water jet nozzles.

For the air drying operation, connections are made from the valve 202 through lines 230, 232 to a normally closed valve 234 in the line 232. The line also includes a pressure regulator 236, and gauges 240, 242 are provided for registering the pressure and temperature of the air. The valve 234 is a two-way valve, and when opened permits air at the selected volume and pressure to be passed through line 48 to the connection 49 to the manifold of the air drying cylinder 16.

For the cable lubricating operation, the control system provides air pressure which is utilized to pump the oil to the lubricating unit. As shown in FIG. 8A, a three-way valve 246 is connected in a line 248 from the line 230. The valve 246 is normally closed, and when opened permits air under pressure to be applied through a line 250 for use in pumping oil in a manner to be explained. The line 248 includes a pressure regulator 252 and a pressure gauge 254 for use in adjusting the pressure of air to be used for this purpose.

For such pumping of oil, the line 250 is connected at 255 to an air motor 256 (FIG. 8B). The air motor 256 powers a fluid pump 258 which is connected to an oil supply, here shown as drums of oil 260, 262 interconnected with the fluid pump via a ball valve 264. The pump 258 is adapted to pump to oil to the high pressure needed for the jet lubricating operation. Oil from the pump passes through a strainer 266 and the line 53 to the connection 54 of the associated manifold of the cylinder 16.

The operations of the valves 220, 234 and 246 are controlled via automatic means within the system. However, the system includes manually operable valves for selectively determining which one or combination of the cable treatment functions is desired in the event that fully automatic operations are to be circumvented. In this latter regard, there is shown a manually operable ball valve 276 for selectively preventing the hydraulic valve 220 from being closed, a similar valve 278 for preventing the valve 234 from opening, and valve 280 for preventing the valve 246 from being opened. The manual valves 276, 278 and 280 are normally opened to permit automatic operations to take place, and are closed as desired for preventing all but the desired cable treating functions to take place when full automatic operations are not wanted.

To effect the automatic operations, use is made of the buildup of pressure when the control button 210 is pressed to close the switch 208. For this, a three-way valve 282 is connected between the line 203 and the normally open manual valve 278, the valve 282 being normally closed and adapted to be opened upon application of sufficient air pressure to its control connection 284. The connection is coupled to the line 207, through which air bleeds through the switch due to the function of the control orifice valve unit 206. A similar, normally closed three-way valve 286 is connected between the manual valve 280 and a line 288 that extends from the side of the valve unit 206 that is connected to the line 203. The manual valve 280 is connected at 290 to the control connection 292 of the normally closed valve 246. The valve 286 has its control connection 294 coupled via a volume or buffer tank 296 and a flow control valve 298 to the junction between the valve 282 and the line 300 that extends between the valve 282 and the manual valve 278.

The hydraulic valve 220 is of the type that is adapted to be pneumatically controlled. In one arrangement, the control side has two input connections 310, 312. The connection 310 is coupled through the manual valve 276 to the junction between the manual valve 280 and the valve 286. The connection 312 is coupled via a volume tank 314 and pressure regulator 316 to a line 318 that extends from the main valve 202.

Whereas the valves 234 and 246 are opened when air pressure is applied to their single control input connections 304, 292, the valve 220 requires a predetermined pressure differential between its input connections 310, 312. In the example mentioned, the control side 312 has air pressure of about 25 psi present when the system is on and the control button 210 is not pressed, i.e., the switch 208 is open. A pressure of 100 psi is to be applied to the other input connection 310 when the control button is pressed.

When the control button is pressed, cutting off bleed of air to the atomosphere, pressure builds up immediately. The pressure quickly reaches a level, e.g., 35-psi, at the control input connection 284 of the valve 282. The valve 282 opens to permit pressure to be applied through the manual valve 278 to the control input connection 304 of the valve 234 and causing it to open. This causes air to be applied through the valve 234 from the line 232, so that air at the desired pressure is applied through the line 48 to the manifold connection 49 of the air cylinder. In this regard, in the arrangement described the air pressure applied to the nozzles in the air cylinder is 120-psi, and air flow is 175-cfm.

With the opening of the valve 282, the valve 286 is opened due to the application of pressure through the flow control valve 298 and tank 296 to the control input connection 294 of the valve 286. The opening of the valve 286 connects the control input connection 310 of the valve 220 to pressure in the line 300. With the pressure applied to the control connection 310 being of the order of 100-psi, the pressure differential between the connections 310, 312 is sufficient to close the valve 220. As previously explained, this stops the circulating mode, and causes the water at the desired flow and pressure to be applied through the lines 216, 43 to the associated manifold input connection 44. In the previously mentioned example, the water flow through the nozzles of the cylinder 12 is 20-gpm at a pressure of 10,000-psi.

It is to be noted that as a wet cable from the cylinder 12 enters the air drying cylinder 14, the water on the cable causes corresponding drops in the temperature and volume of air flow along the length of the cylinder 14. With the air nozzles having their tips oriented at progressively larger angles to direct flow upstream in the cylinder, the flow is effectively reinforced by the successive sets of nozzles upstream of the exit end of the cylinder 14. These reinforcing jets of air combine to draw all moisture from the cable towards the inner wall of the cylinder 14, and, while drying the cable, the air flow forces the water out of the entrance end of the air cylinder and back into the cylinder 12. The volume of air at the meeting ends of the two cylinders 14, 12 is sufficient to keep out water that deflects from the cable in the cylinder 12, and aids in forcing such water to flow out of the dump tube 102. It will be understood that suitable baffling may be added as desired to enhance such dumping. Desirably, the air source 200 supplies air at a somewhat elevated temperature, e.g., 100° F. The higher temperature air is effective in drawing off moisture from the cable and drying the cable more quickly than air at ambient temperature conditions.

The logic arrangement of valves as above described also causes the valve 246 to open along with the opening of the valve 234 and closing of the valve 220. In this regard, the opening of the valve 286 as described causes pressure to be applied through the manual valve 280 and the line 290 to the control connection 292 of the valve 246. Opening of the valve 246 thus causes air flow through the lines 248,250 for operating the air motor 256 and oil pump 258 as above explained. For lubricating a cable, in the arrangement above described the oil is applied to the nozzles of the lubricating cylinder 16 at pressures up to 5,000 psi.

A control system in accordance with this invention is adapted to properly treat a cable that is moving at high speed with the pressures selected for the water, drying air and lubricating oil. In this regard, the system shown and described above operates with the pressures mentioned to clean, dry and oil a 2.5-in. cable that moves through the cylinders at one foot per second. This is the speed at which a winch hauls in an anchor cable. As will be appreciated, the apparatus is set up on deck ahead on the winch, and the cable threaded into place, following which the connections are made to the manifold inputs from the air and water sources and the oil pump as described.

As previously indicated, the oil exiting the cylinder 16 through the tube 170 is available to be reused. To this end, the control system of FIG. 8A and 8B is shown to include a drip pan, indicated in phantom at 330, into which oil from the tube connection 172 and line 174 is directed. A float 332 is provided to operate a normally closed valve inlet to an oil pump 334. The pump is operable by an air motor 336 to pump oil from the drip pan 330 through a line 338 to the oil supply, here shown as the top of the upper drum 260, via a ball valve 340.

Air pressure to drive the motor 336 is supplied through a line 342 that includes a pressure regulator 344 and a pressure gauge 346. The line 342 is shown connected via a ball valve 348 to an auxiliary air source 350. The auxiliary source may be cut in with the valve if needed so as to provide additional air flow if needed to operate the small air motor 336. In one example, the auxiliary air source 350 is an air compressor which supplies air at 125-psi and 50-cfm.

Figure 9:
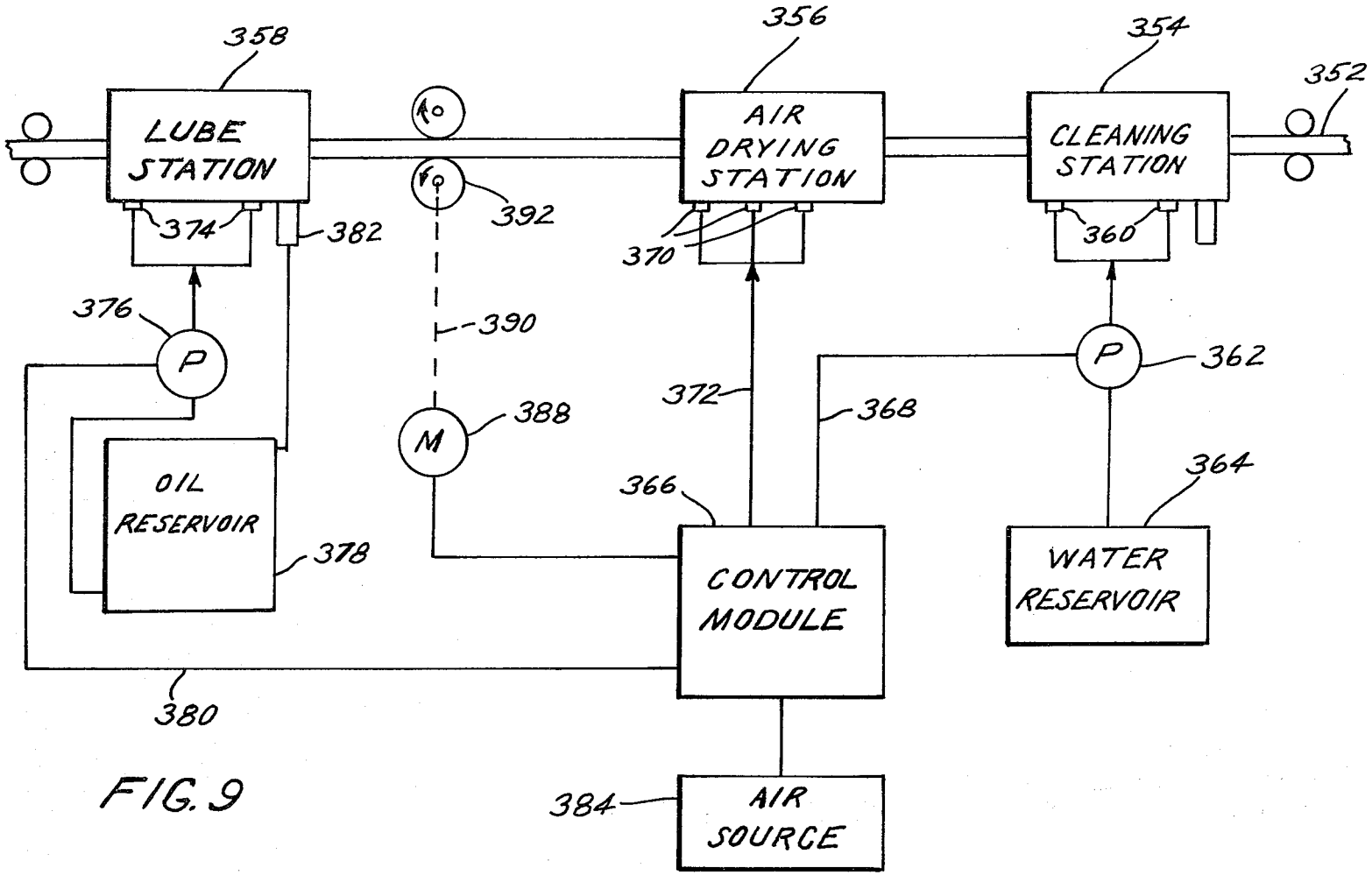
FIG. 9 is a modified control system showing motor means for moving a cable, and controllable by the control system to adjust the speed of the cable in accordance with the flows and pressures of the fluids used for washing, drying and lubricating the cable.

This invention also includes controls for moving the cable that is to be cleaned. Referring to FIG. 9, a system is shown in which a cable 352 moves through aligned treatment stations 360, 362, 364 labeled as indicated for cleaning, air drying, and lubricating the cable. The station 354 is illustrated schematically with nozzles 360 connected as indicated to a water pump 362 that is adapted to pump water from a reservoir 364 at the desired volume and pressure. The pump operation is controlled from a control module 366, as via a connection 368. Similarly, the station 356 has interconnected nozzles 370 which are connected at 372 to the control module 366. The lube station 358 has nozzles 374 to be supplied with oil from a pump 376 that is connected to an oil reservoir 378, the pump 376 being shown connected at 380 to the control module 366. The station 358 has a dump tube 382 from which oil is adapted to enter the oil reservoir 378.

The control module is connected to an air source 384, and includes logic suitable for operating the pumps 362, 376, and supplying air to the station 356, much in the manner described with reference to FIGS. 8A and 8B. In addition, the control module is similarly adapted to operate an air motor 388 which is coupled at 390 to pinch rollers 392 located between the air drying station 356 and the lube station 358.

In this latter regard, the cable leaving the air drying station is clean and dry, where it is best engaged by the rollers 392 and moved without the slippage encountered by attempting to move the cable after it is lubricated. Due to the control of the motor from the same central module that controls the application of the water, air and oil to the nozzles of the various stations, the treatment system of FIG. 9 permits cable speed to be adjusted in accordance with the pressures selected for the fluids being applied. Thus, if the cable is to be cleaned with water that is at a relatively low pressure, the cable must be moved at a slower speed than in the example above described. Correspondingly, the lubrication is effected at a lower pressure. Air drying in such cases may be carried out at the same flow and pressure as in the higher speed situation, but with less than all sets of air nozzles in use.

The system described is sturdy and compact. The arrangement described is one in which the overall length of a unit is eight feet. The cylinders 12, 16 are approximately 18-inches long, formed of 8-in. diameter pipe. The cylinder is approximately 24-inches long, formed of pipe having an internal diameter of four inches. The base is channel iron approximately 8-in. wide and 4-in. deep.

Various modifications can be made in the structure and control system logic without departing from the spirit and scope of this invention. The number, spacing and arrangement of the nozzles can vary significantly while still performing the functions described. While the system has been described for treatment of cables used in an ocean environment, it will be understood that cable and pipe used in a variety of locations can be treated with the apparatus of this invention. Different fluids may be used, e.g., cleaning solvent instead of water, or in addition to water, as by using respective cylinders for solvent cleaning and water wash. Automatic valves in the control system may be either spring-biased to normally closed or open positions. Still further, whereas the invention has been described for treating cable that moves through the cylinders, this invention embraces its use by moving the unit along a cable.

We claim:

1. In combination:

an elongated first cylinder adapted for receiving a cable, said cylinder having entrance and exit ends;

nozzle means supported by said cylinder, said nozzle means having spaced nozzle inputs along said cylinder beginning adjacent said exit end, each of the nozzle inputs being adapted to direct air tangentially of the cable, each of the nozzle inputs also being adapted to direct air towards said entrance end at a respective angle with respect to a diametral plane, the angles increasing so the angle of the nozzle inputs adjacent said exit end is less than the angle of nozzle inputs spaced along said cylinder;

and means to apply air under pressure to said nozzle means.

2. The combination of claim 1, further including a second cylinder, said second cylinder being coaxial with the first cylinder so that the cable passes through both;

nozzle means supported by said second cylinder; means to apply a liquid under pressure to the nozzle means of said second cylinder, said nozzle means of said second cylinder being operable to direct the liquid radially inward over a narrow angle to impinge against the cable therein.

3. The combination of claim 2, wherein said cylinders are in end to end confronting relation so that the cable upon exiting said second cylinder immediately enters said first cylinder, said nozzle means of said first cylinder being effective to cause air flow sufficient to prevent liquid from entering said first cylinder.

4. The combination of claim 3, further including a third cylinder through which the cable is adapted to pass from said first cylinder, and coaxial with said first cylinder;

nozzle means supported by said third cylinder;

and means to apply liquid under pressure to the nozzle means of said third cylinder, said nozzle means of said third cylinder being operable to direct the liquid radially inward over a narrow angle to impinge against the cable therein.

5. The combination of claim 4, wherein each of said cylinders is a split cylinder;

a base;

means supporting said cylinders in said coaxial relation above said base, said cylinder support means including plates on said base, each half of each cylinder having at least two arms adjacent the ends of such half, each pair of arms being pivotally mounted on a respective plate;

limit stop means on each plate engaging a respective arm when the halves of the associated cylinder are together;

and respective releasable clamping means for the end portions of the halves of each cylinder.

6. The combination of claim 5, wherein the means to apply liquid to the nozzle means of said second cylinder is adapted for connection to a supply of water, and the means to apply liquid to the nozzle means of said third cylinder is adapted for connection to a supply of oil, and the means to apply air to the nozzle means to said first cylinder is adapted for connection to a supply of dry, compressed air;

and control means operable from the air supply for permitting the application of water and oil to the nozzle means of the associated cylinders.

7. The combination of claim 6, including manual valve means operable as to permit the operation of any one or combination of said means for applying air, water and oil to the nozzle means of the associated cylinders.

8. The combination of claim 7, wherein said manual valve means are interconnected with said control means.

9. The combination of claim 8, including automatic valve means in said control means for effecting operations of the respective means for applying air, water and oil to the nozzle means of the associated cylinders.

10. The combination of claim 5, including respective manifolds for the means for applying air, water and oil to the nozzle means of the associated cylinders;

fittings spaced along said base which are connected to said manifolds, said manifolds being located beneath the associated cylinders;

and hose connections from the nozzle means of said cylinders to the fittings beneath them, whereby the fluids applied to said manifolds are applied directly to said nozzles through said hose connections.

11. The combination of claim 5, wherein said nozzle means each include two sets of nozzles spaced axially along the assoicated cylinder, each set including a pair fixed to a respective cylinder half;

a connection between the nozzles of each pair;

and a hose connection from each connected pair to a respective fitting.

12. The combination of claim 11, wherein each hose connection extends below the associated cylinder and across said base to a fitting on the other side of said base, each hose connection extending across said base so as to cross the pivot axis of said cylinder halves.

13. The combination of claim 12, wherein the cylinder to which air is supplied includes a third set of nozzles with a pair of each cylinder half interconnected and connected by hose connections to respective fittings on said base, the sets of nozzles of each cylinder being spaced along the axis thereof, with the nozzles of each set being spaced 90° apart around the cylinder, and the nozzles of one set being angularly spaced 45° with respect to the nozzles of the adjacent set on the same cylinder, the nozzles of the cylinder to which air is supplied having one set located immediately adjacent the exit end of the cylinder.

14. The combination of claim 13, wherein the nozzles of the cylinder to which water is supplied are adapted to direct water radially inward over respective predetermined narrow angles, and the nozzles of the cylinder to which oil is supplied are adapted to direct oil radially inward over respective predetermined larger angles.

* * * * *